US008925234B1

(12) United States Patent
Barrett

(10) Patent No.: US 8,925,234 B1
(45) Date of Patent: Jan. 6, 2015

(54) BOLT ACTION RIFLE WITH SAFETY LATCHING MECHANISM

(76) Inventor: Christopher Gene Barrett, Murfreesboro, TN (US)

( * ) Notice: Subject to any disclaimer, the term of this patent is extended or adjusted under 35 U.S.C. 154(b) by 0 days.

(21) Appl. No.: 13/608,257

(22) Filed: Sep. 10, 2012

Related U.S. Application Data

(63) Continuation of application No. 13/134,830, filed on Jun. 17, 2011, now Pat. No. 8,261,479, which is a continuation of application No. 12/386,037, filed on Apr. 13, 2009, now Pat. No. 7,966,762.

(51) Int. Cl.
*F41A 21/00* (2006.01)
*F41A 3/66* (2006.01)

(52) U.S. Cl.
CPC ..... *F41A 3/66* (2013.01)
USPC ..... 42/75.03; 42/16; 42/75.01; 42/14

(58) Field of Classification Search
USPC ..... 42/14, 16, 75.03
See application file for complete search history.

(56) References Cited

U.S. PATENT DOCUMENTS

| | | | | |
|---|---|---|---|---|
| 6,178,682 | B1 * | 1/2001 | Zedrosser et al. | 42/16 |
| 6,182,389 | B1 * | 2/2001 | Lewis | 42/16 |
| 6,212,814 | B1 * | 4/2001 | Lambie | 42/75.03 |
| 7,827,721 | B2 * | 11/2010 | Griffin | 42/73 |
| 7,966,762 | B2 * | 6/2011 | Barrett | 42/75.03 |
| 8,056,280 | B2 * | 11/2011 | Lesenfants et al. | 42/85 |
| 8,312,661 | B2 * | 11/2012 | Ludlow | 42/73 |
| 2008/0190005 | A1 * | 8/2008 | Rohrauer | 42/75.01 |
| 2009/0277066 | A1 * | 11/2009 | Burt et al. | 42/6 |
| 2010/0071246 | A1 * | 3/2010 | Vesligai | 42/75.03 |
| 2010/0175290 | A1 * | 7/2010 | Duplessis et al. | 42/16 |
| 2010/0229445 | A1 * | 9/2010 | Patel | 42/6 |
| 2012/0137561 | A1 * | 6/2012 | Ludlow | 42/75.03 |

* cited by examiner

*Primary Examiner* — Samir Abdosh
(74) *Attorney, Agent, or Firm* — Waddey & Patterson, P.C.; Ryan D. Levy

(57) ABSTRACT

A bolt action rifle with safety latching mechanism has an upper receiver including a movable bolt assembly, a lower receiver having a trigger assembly and releasably attached to the upper receiver, the bolt assembly movable between a cocked position and an uncooked position, and the upper receiver and the lower receiver including a latching mechanism operable to prevent the lower receiver from being detached from the upper receiver while the bolt assembly is in the cocked position.

4 Claims, 9 Drawing Sheets

BOLT ACTION RIFLE WITH SAFETY LATCHING MECHANISM

CROSS-REFERENCE TO RELATED APPLICATION

The present application claims priority to and is a continuation of U.S. patent application Ser. No. 13/134,830, entitled "Bolt Action Rifle with Safety Latching Mechanism," filed Jun. 17, 2011 which claims priority to and is a continuation of U.S. patent application Ser. No. 12/386,037, entitled "Bolt Action Rifle with Safety Latching Mechanism," filed Apr. 13, 2009 which issued as U.S. Pat. No. 7,966,762 on Jun. 28, 2011.

FIELD OF THE INVENTION

The present invention relates to a bolt action rifle with separable upper and lower receivers, with a safety latching mechanism to prevent separation of the lower receiver from the upper receiver while the rifle is cocked to fire.

BACKGROUND OF THE INVENTION

Bolt action rifles with safety latching mechanisms are desirable for preventing separation of the lower receiver from the upper receiver while the rifle is cocked to fire. The term bolt action refers to a type of firearm action in which the weapon's bolt is operated manually by the opening and closing of the breech with a small handle, most commonly placed on the right-hand side of the weapon. As the handle is operated, the bolt rotates and is unlocked, the breech is opened, a spent shell casing may be withdrawn and ejected, and finally, a new round is fed into the breech and the bolt is closed. Bolt action firearms are typically rifles, and they have earned a reputation for being more accurate and reliable than typical semi-automatic rifles. For this reason, they are still the choice of many target shooters and military and law enforcement snipers.

The use of magazine-fed bolt action rifles is known in the prior art, although the use of separable upper and lower receivers for bolt-action rifles is atypical. For example, one prior art magazine-fed bolt action rifle has an upper receiver and a lower receiver that are releasably connected to one another by a front lock pin and a rear lock pin. The manufacturer advises that the bolt be unlocked before the lock pins are removed and the receivers separated. However, a user's failure to follow these instructions would result in an unintended discharge of the rifle if the rifle were loaded and the bolt locked when the receivers separated. Normally, the trigger mechanism has a protruding element that restrains the firing pin until the trigger is pulled. Separation of the receivers with the rifle loaded and cocked allows the trigger to disengage from the compressed firing pin spring; the released firing pin spring in turn forces the firing pin forward for discharge.

Furthermore, in the case of the known magazine-fed bolt action rifle, a substantial opening in the upper receiver is created when the bolt is closed. Dirt and debris could enter the upper receiver and lower receiver through the opening, potentially interfering with the movement of the bolt and the trigger mechanism.

Therefore, a need exists for a new and improved bolt action rifle with safety latching mechanism that can be used for preventing separation of the lower receiver from the upper receiver while the rifle is cocked to fire. In this regard, the various embodiments of the present invention substantially fulfill at least some of these needs. In this respect, the bolt action rifle with safety latching mechanism according to the present invention substantially departs from the conventional concepts and designs of the prior art, and in doing so provides an apparatus primarily developed for the purpose of preventing separation of the lower receiver from the upper receiver while the rifle is cocked to fire.

SUMMARY OF THE INVENTION

The present invention provides an improved bolt action rifle with safety latching mechanism, and overcomes the above-mentioned disadvantages and drawbacks of the prior art. As such, the general purpose of the present invention, which will be described subsequently in greater detail, is to provide an improved bolt action rifle with safety latching mechanism that has all the advantages of the prior art mentioned above.

To attain this, the preferred embodiment of the present invention essentially comprises an upper receiver including a movable bolt assembly, a lower receiver having a trigger assembly and releasably attached to the upper receiver, the bolt assembly being movable between a cocked position and an uncooked position, and the upper receiver and the lower receiver including a latching mechanism operable to prevent the lower receiver from being detached from the upper receiver while the bolt assembly is in the cocked position.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
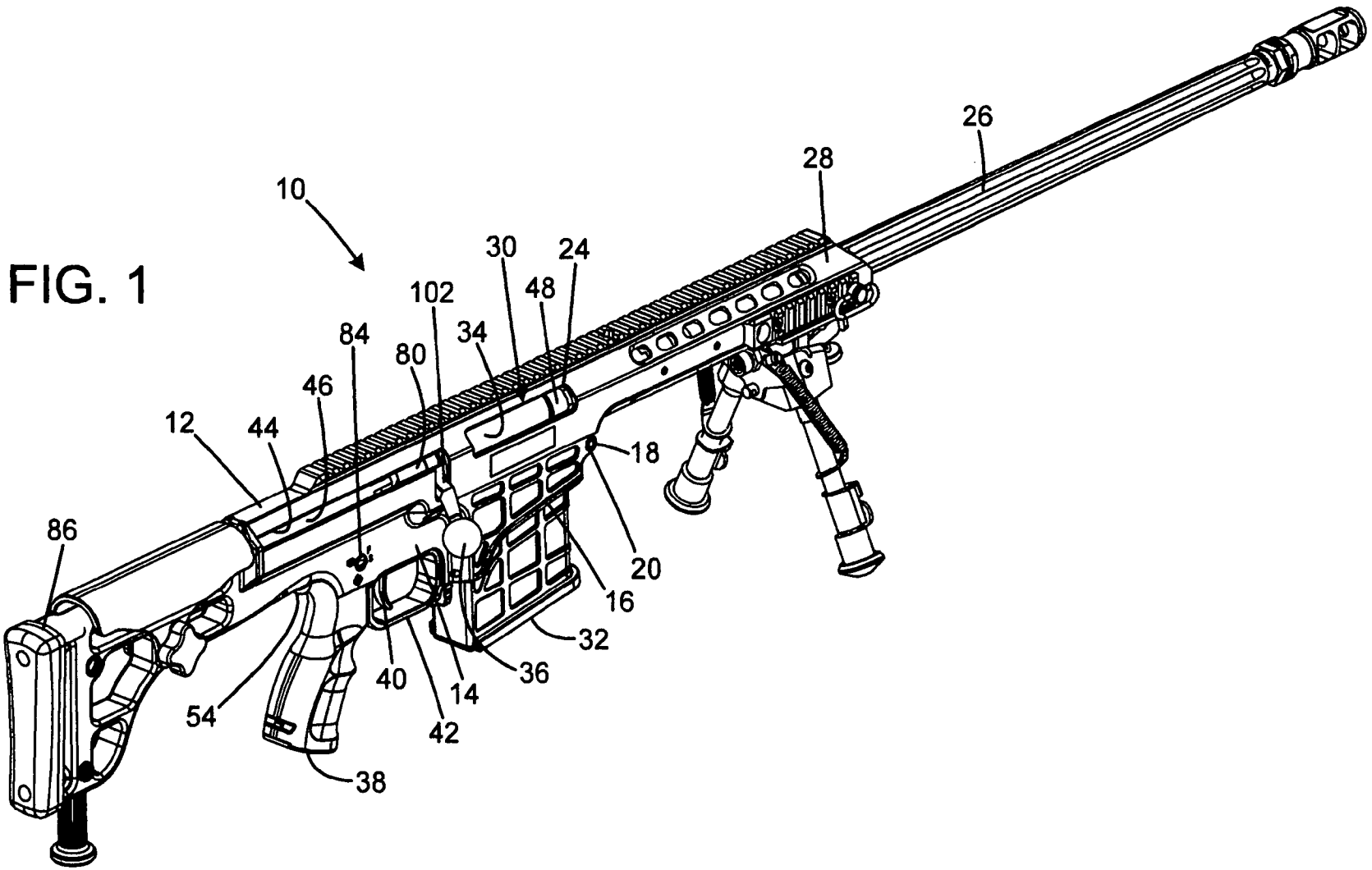
FIG. 1 is a top perspective view of the current embodiment of the bolt action rifle with safety latching mechanism constructed in accordance with the principles of the present invention.

A preferred embodiment of the bolt action rifle with safety latching mechanism of the present invention is shown and generally designated by the reference numeral 10.

FIG. 1 illustrates improved bolt action rifle with safety latching mechanism of the present invention. More particularly, the bolt action rifle with safety latching mechanism 10 has an upper receiver 12 detachably connected to a lower receiver 14. The upper receiver 12 is an elongated hollow tube. The upper receiver 12 has a front portion that forms a barrel shroud 28 and a rear portion that contains a bolt assembly 30. The barrel shroud 28 receives the rear end of a barrel 26. The lower receiver 14 includes a pistol grip 38, a safety switch 84, a trigger 40 enclosed by a trigger guard 42, a magazine well 16 that receives a detachable magazine 32, and a stock 86.

Figure 2:
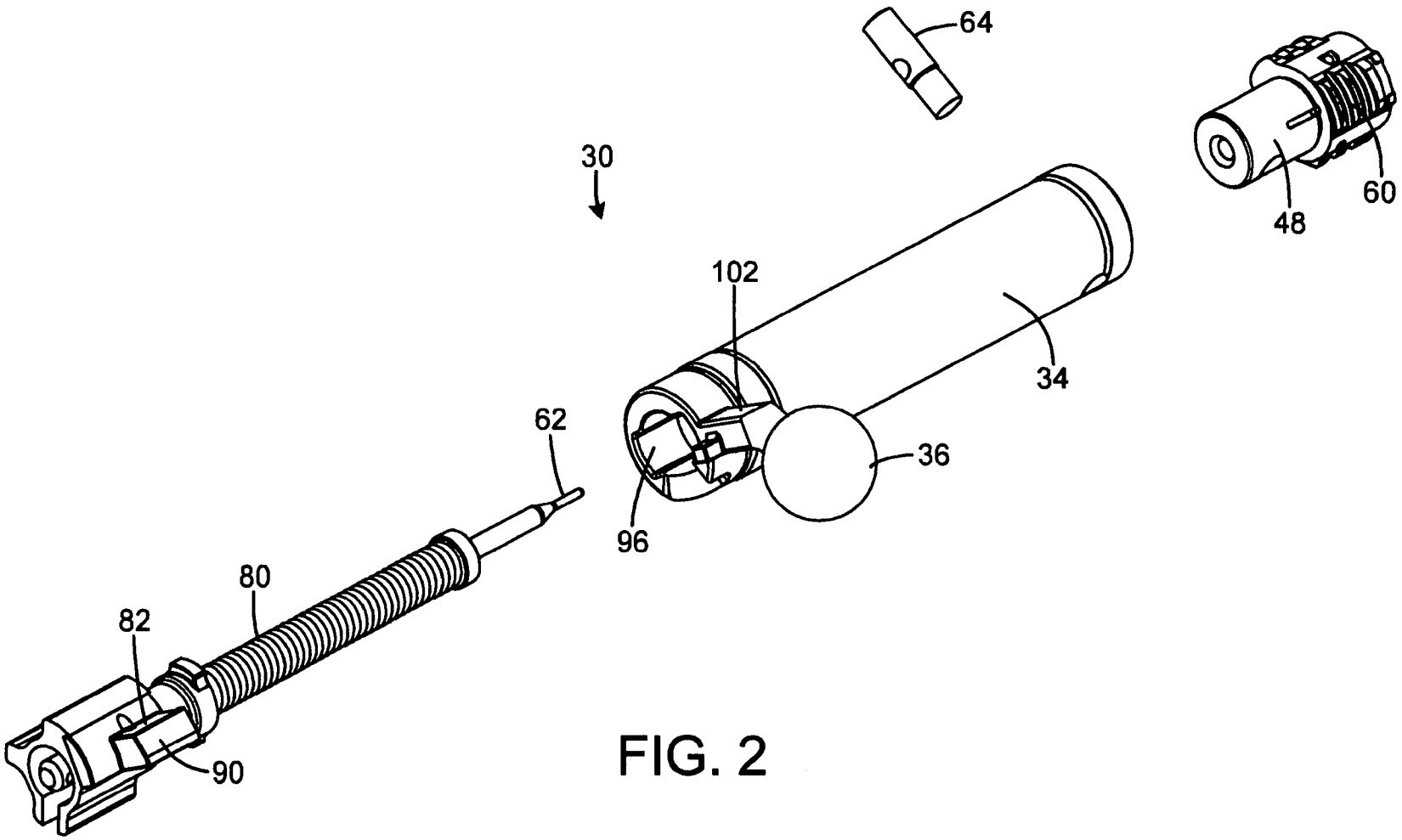
FIG. 2 is a top perspective exploded view of the current embodiment of the bolt assembly of the present invention.

FIG. 2 illustrates the bolt assembly 30 of the present invention. More particularly, the bolt assembly 30 consists of a bolt tube 34 having a hollow center 96 and a bolt handle 36 protruding from its rear end. The bolt tube 34 is a cylindrical body having a maximum diameter substantially along its length, as opposed to a more slender shank as employed in many bolt action rifles. The bolt handle 36 is a round knob that is threadedly connected to the bolt tube 34 by a generally rectangular protrusion 102 extending from the rear end of the bolt tube 34. A bolt head 48 having bolt head threads 60 on its front end has its rear end releasably secured to the front end of the bolt tube 34 by a bolt securing pin 64. The bolt head threads 60 have an outside diameter that is about the same as the diameter of the bolt tube 34 and does not exceed the diameter of the bolt tube 34. Thus, a bore that closely receives the bolt tube 34 will also receive the bolt head threads 60. A firing pin 62 and firing pin spring 80 are inserted through the rear end of the bolt handle 36. A cocking piece shroud 82 is attached to the rear of the firing pin spring 80 opposite the firing pin 62. A generally rectangular cocking piece tab 90 protrudes outwardly from the side wall of the cocking piece shroud 82.

Figure 3:
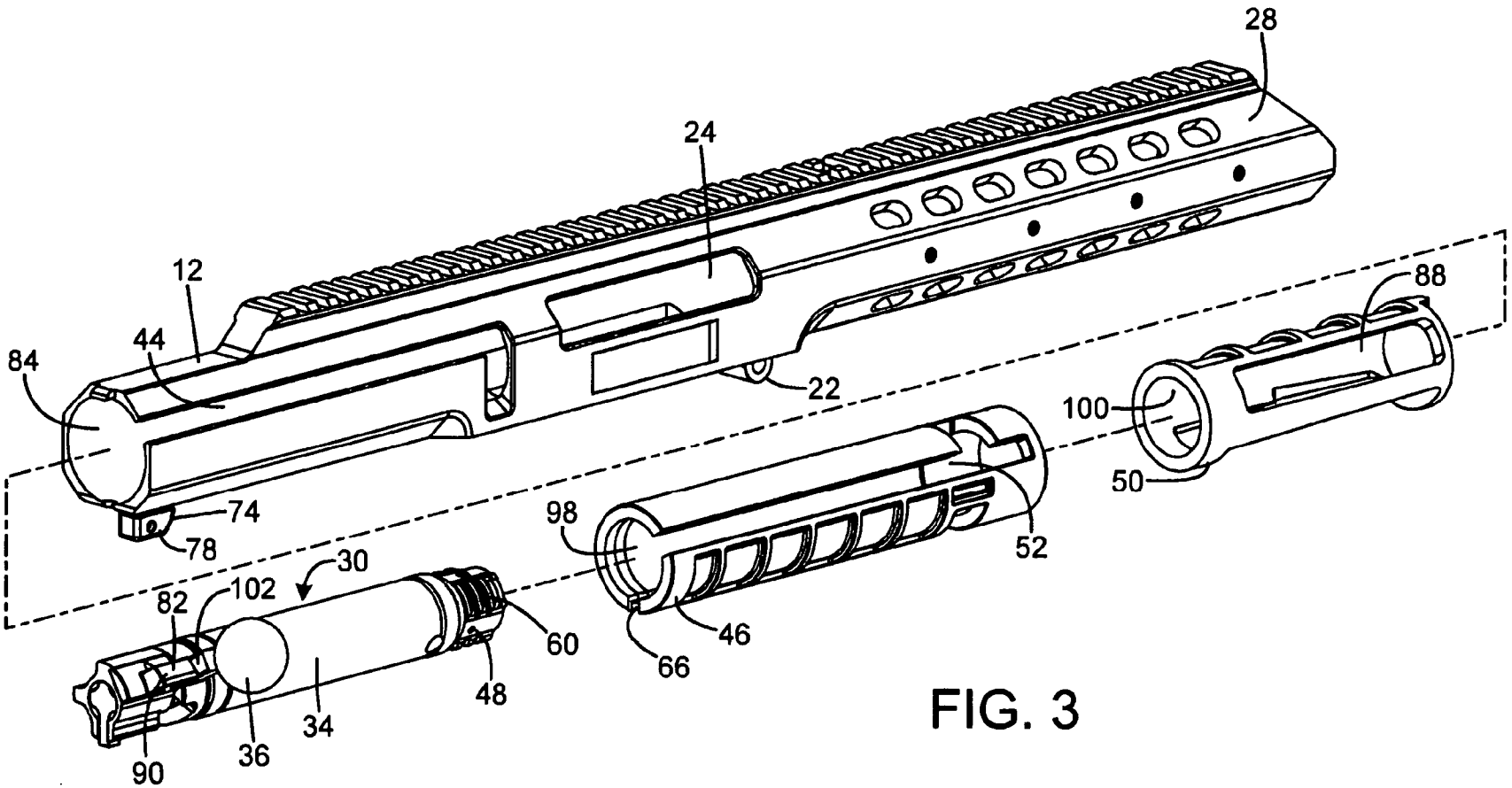
FIG. 3 is a top perspective exploded view of the current embodiment of the upper receiver of the present invention.

FIG. 3 illustrates the upper receiver 12 of the present invention. More particularly, the upper receiver 12 is an elongated hollow tube defining a bore 84 that receives a front bolt guide 50 and a rear bolt guide 46. The upper receiver 12 has an ejection port 24 in the right side of its barrel shroud, an L-shaped bolt handle slot 44 in the right side of its rear, an upper receiver tab 78 at the bottom of its rear, and a takedown pin sleeve 22 on the bottom of its midpoint. The upper receiver tab 78 is a generally rectangular element with an attached receiver latch seat 74. The receiver latch seat 74 has an angled portion protruding from the upper receiver tab 78 towards the takedown pin sleeve 22.

The front bolt guide 50 is a tubular element defining a bore 100 having a plurality of slots in its side wall, one of which is an ejection port slot 88. The bore 84 closely receives the exterior of the front bolt guide 50. When the front bolt guide 50 is inserted into the bore 84, the ejection port slot 88 lines with the ejection port 24 on the upper receiver 12 when the bolt handle 36 is lifted to eject the casing of a spent cartridge.

The front bolt guide 50 has a solid portion above the ejection port slot 88 that blocks the upper receiver ejection port 24 when the bolt handle 36 is in the lowered position, as when the rifle 10 might normally be carried and susceptible to debris. The front bolt guide 50 is rotationally engaged to the bolt assembly 30 and is axially aligned to the upper receiver 12. The front bolt guide 50 is engaged by the rear bolt guide 46, which is engaged by the bolt handle 36.

The rear bolt, guide 46 is a tubular element defining a bore 98 having a rear bolt guide slot 52 in its side wall and a notch 66 in its rear. The rear bolt guide slot 52 is generally L-shaped with its horizontal stroked portion offset from one end of its vertical stroked portion. The bore 84 closely receives the exterior of the rear bolt guide 46. When the rear bolt guide 46 is inserted into the bore 84, the rear bolt guide slot 52 is aligned with the bolt handle slot 44.

The bolt assembly 30 is inserted into the rear of the upper receiver 12 through the rear bolt guide 46 and front bolt guide 50. The interior bore 100 of the front bolt guide 50 and the interior bore 98 of the rear bolt guide 46 closely receive the bolt assembly 30. The bolt handle 36 reciprocates axially within the bolt handle slot 44 and the rear bolt guide slot 52. Both the protrusion 102 from the bolt tube 34 and the cocking tab 90 are shaped to be closely received by the bolt handle slot 44 and the rear bolt guide slot 52.

Figure 4:
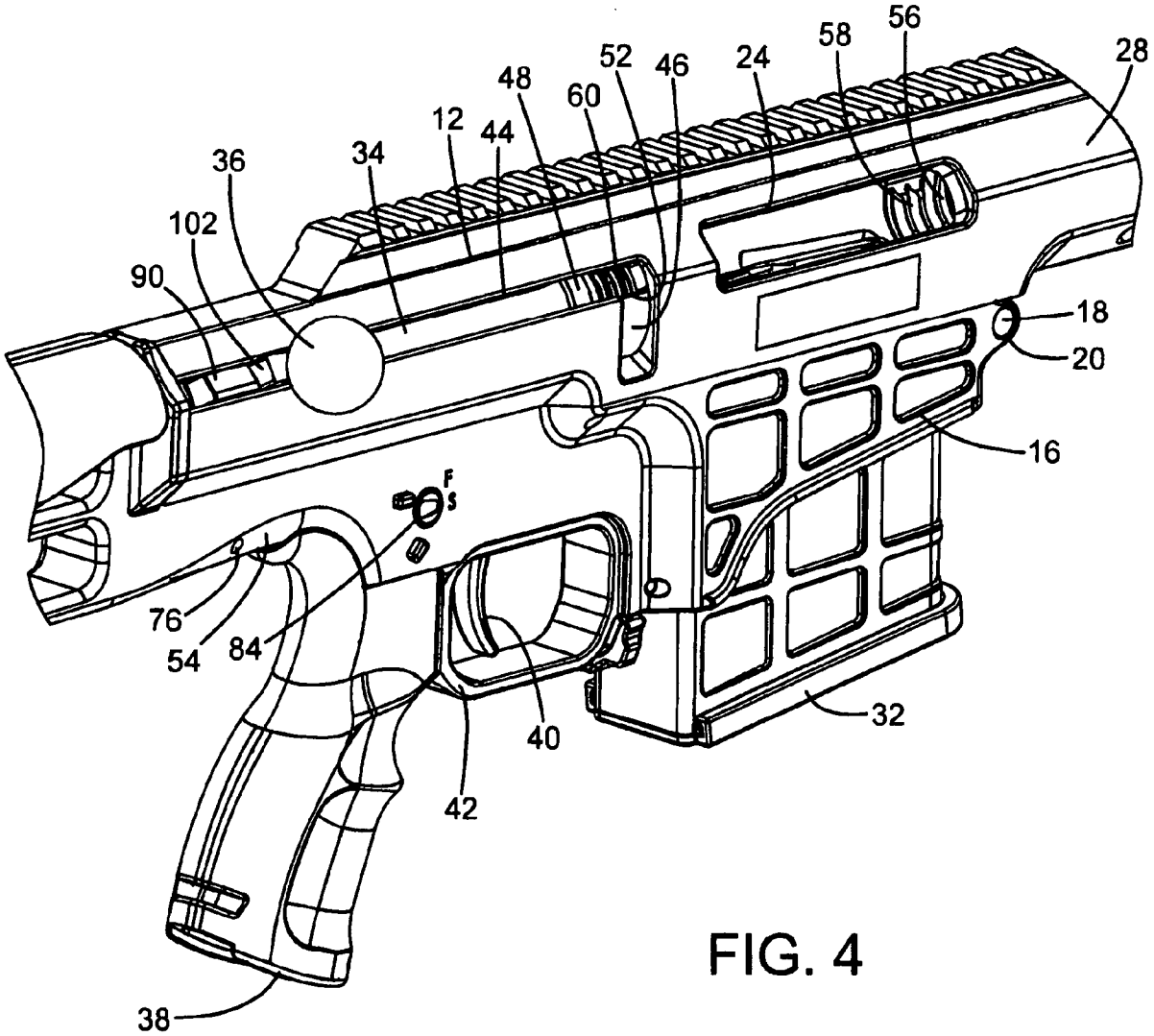
FIG. 4 is a top perspective fragmentary view of the current embodiment of the bolt action rifle with safety latching mechanism of the present invention.

FIG. 4 illustrates the bolt action rifle 10 of the present invention. More particularly, the upper receiver 12 is hingedly and removably connected to the lower receiver 14 by a removable or captive takedown pin 18 inserted through a takedown pin hole 20 in the front of the magazine well 16 of the lower receiver 14 and the takedown pin sleeve 22 attached to the bottom of the upper receiver 12. The upper receiver 12 can be completely disconnected from the lower receiver 14 at this point by removal of the takedown pin 18. The upper receiver 12 is releasably connected to the lower receiver 14 at a point to the rear of the pistol grip 38 by a latching mechanism 104 that includes a receiver latch 54. The latching mechanism 104 is depicted in detail in FIGS. 6 and 7 and will be described subsequently.

The position of the bolt handle 36 within the bolt handle slot 44 defines the status of the bolt assembly 30. When the bolt handle 36 is retracted all the way to the rear of the upper receiver 12, the bolt assembly 30 is retracted for cartridge ejection and chambering. When the bolt handle 36 is pushed forward all the way to the horizontal stroked portion of the rear bolt guide slot 52, but has not been lowered into the horizontal stroked portion of the rear bolt guide slot 52, the bolt assembly 30 is forward and unlocked. When the bolt handle 36 is both pushed forward all the way to the horizontal stroked portion of the rear bolt guide slot 52 and lowered into the horizontal stroked portion of the rear bolt guide slot 52, the bolt assembly 30 is locked.

In FIG. 4, the bolt handle 36 is shown retracted for cartridge ejection and chambering. The bolt handle 36 is moved to this position after the bolt action rifle 10 is fired by lifting the bolt handle 36 and sliding it to the rear of the bolt handle slot 44. The lifting movement of the bolt handle 36 unlocks the bolt assembly 30 by disengaging the bolt head threads 60 from the chamber threads 58. The sliding action of the bolt handle 36 causes the bolt head 48 to extract a spent casing from the chamber 46 and eject the spent casing through the ejector port 24. Subsequently, a spring within the magazine 32 pushes a new cartridge into place in front of the chamber 56.

To ready the bolt action rifle 10 for firing, the bolt handle 36 is slid to the front of the bolt handle slot 44, which pushes the new cartridge into the chamber 56 and places the bolt assembly 30 in the forward and unlocked position. Subsequently lowering the bolt handle 36 engages the bolt head threads 60 with the chamber threads 58 to seal the rear of the chamber 56 by locking the bolt head 48. This places the bolt assembly 30 in the locked position. Lowering the bolt handle 36 also cocks the firing pin 62 by compressing the firing pin spring 80.

Figure 5:
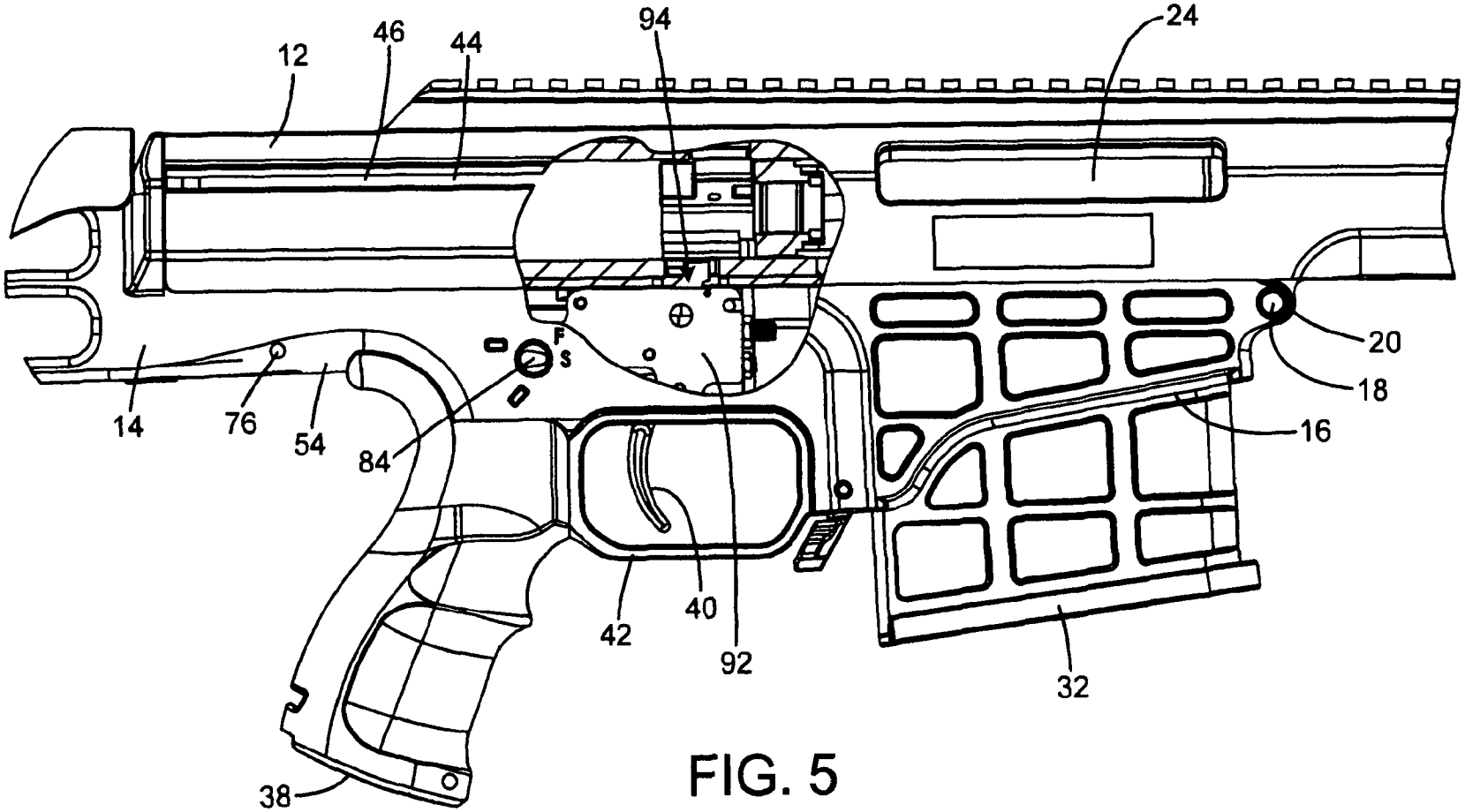
FIG. 5 is a right side sectional view of the current embodiment of the bolt action rifle with safety latching mechanism of the present invention.

FIG. 5 illustrates the bolt action rifle 10 of the present invention. More particularly, the bolt action rifle 10 is depicted ready to fire with a cartridge chambered and the bolt assembly 30 locked. The safety switch 84 has two modes: SAFETY and FIRE. The trigger 40 can be pulled to fire the weapon only when the safety switch 84 is placed on FIRE. When the safety switch 84 is placed on in the FIRE position, the trigger mechanism 94 continues to restrain the firing pin spring 80 and firing pin 62 until the trigger 40 is pulled. The sear 92 is the part of the trigger mechanism that holds the firing pin spring 80 back until the correct amount of pressure has been applied to the trigger 40. Once the correct amount of pressure has been applied to the trigger 40, the sear 92 drops down and releases the firing pin spring 80 so the firing pin 62 can discharge the weapon by igniting the cartridge.

To avoid accidental discharge of the bolt action rifle 10, the user maintains the safety switch 84 in the SAFETY position and keeps his fingers outside of the trigger guard 42 at all times until he is ready to fire the weapon. However, when the bolt assembly 30 is locked, the firing pin 62 could still potentially be released to discharge the weapon without the trigger 40 being pulled regardless of the position of the safety switch 84. This circumstance would occur if the upper receiver 12 were separated from the lower receiver 14 because the sear 92 would no longer be in contact with the firing pin spring 82 hold back the firing pin 62.

Figure 6:
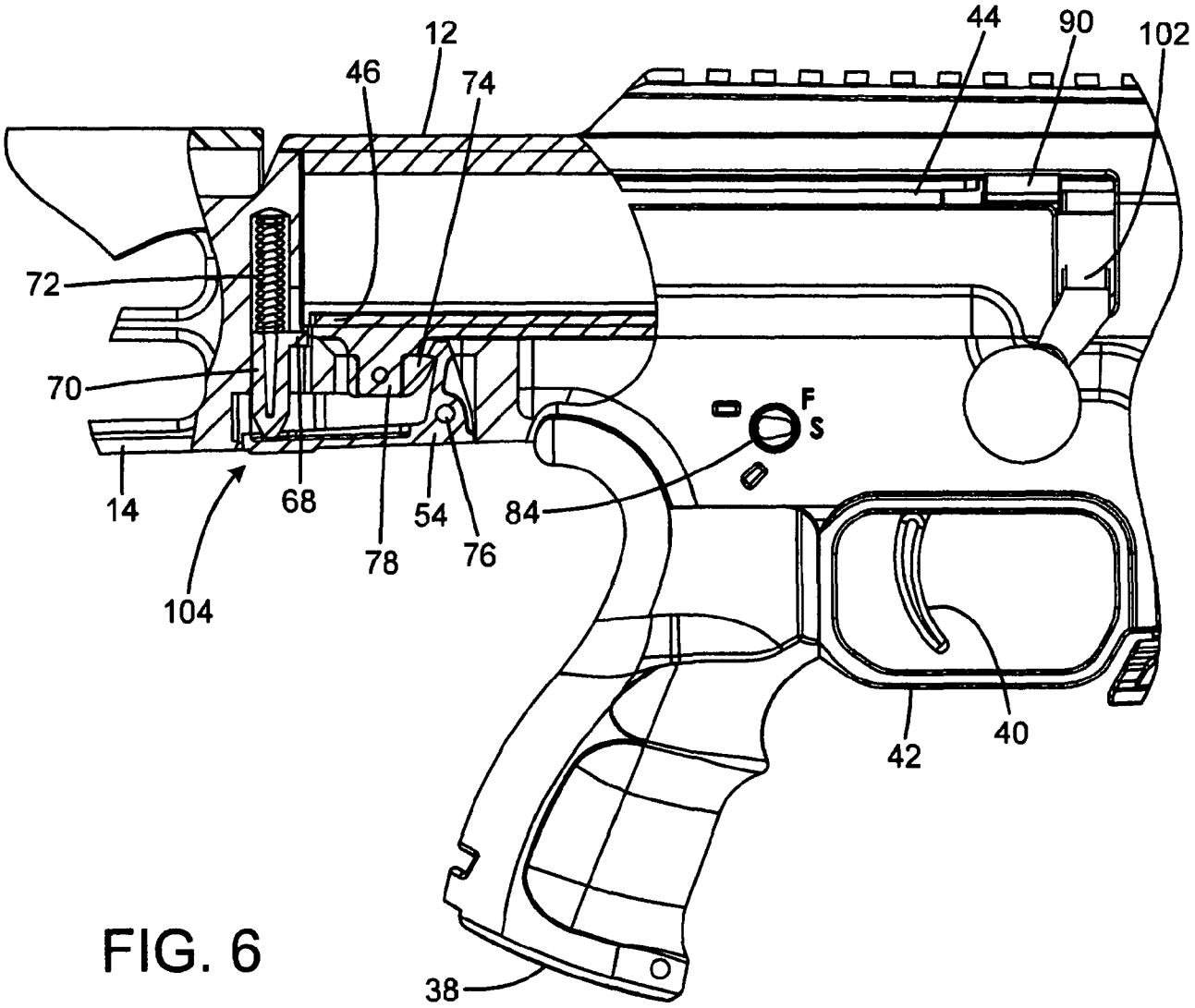
FIG. 6 is a right side sectional view of the current embodiment of the bolt action rifle with safety latching mechanism of the present invention.
Figures 8A, 8B:
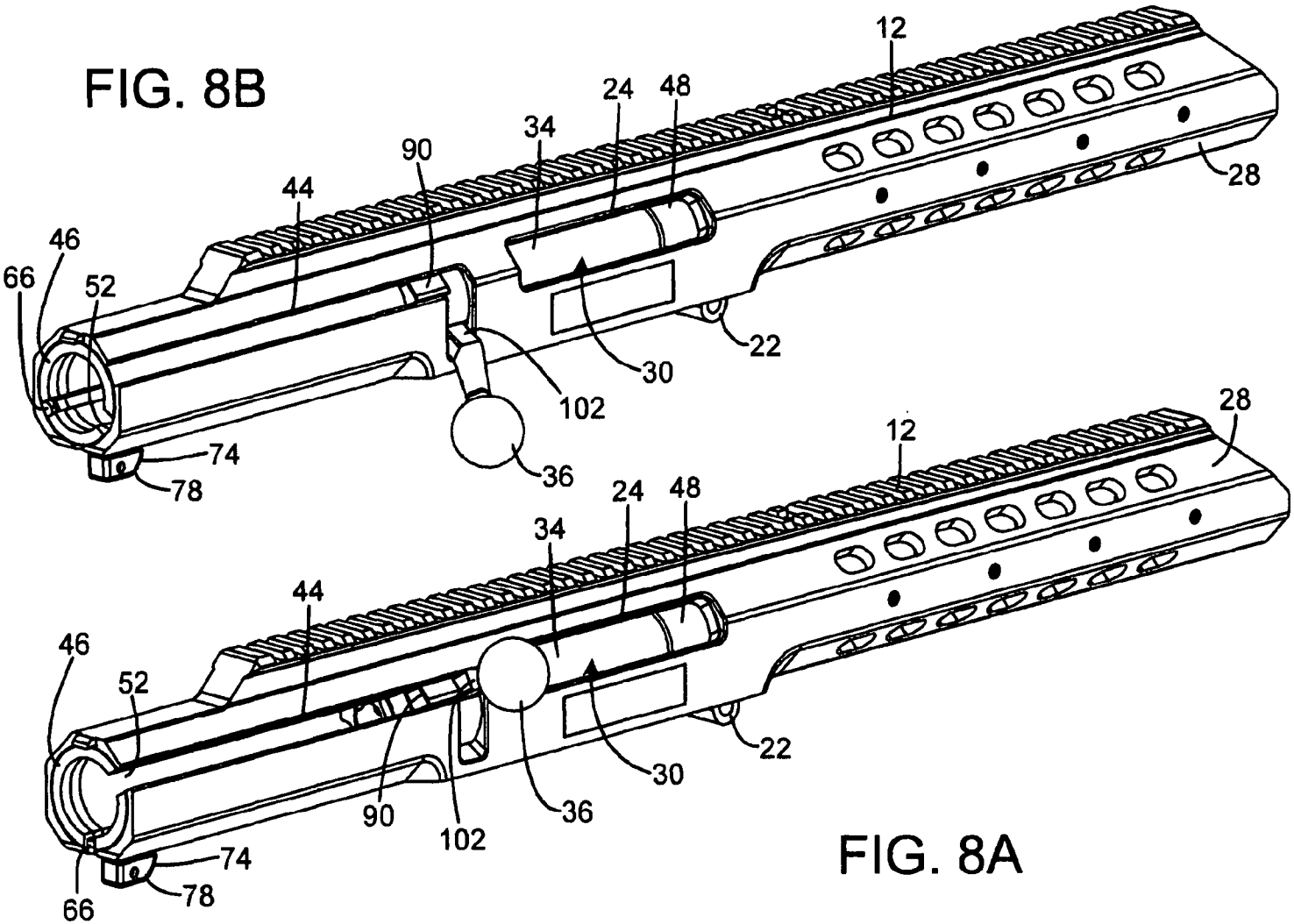
FIGS. 8A and 8B are top perspective views of the current embodiment of the upper receiver of the present invention showing the bolt handle in its open and closed positions, respectively.

FIGS. 6 and 8B illustrate the bolt action rifle 10 of the present invention. More particularly, the bolt action rifle 10 is depicted ready to fire with a cartridge chambered and the bolt assembly 30 locked. The latching mechanism 104 releasably secures the upper receiver 12 to the lower receiver 14. A receiver latch spring 72 mounted inside of the lower receiver 14 biases a bullet-shaped receiver safety latch 70 downwards so that the front of the receiver safety latch 70 pushes against one end of the receiver latch 54. The receiver safety latch 70 has a tab 68 protruding from its rear that contacts the rear side wall of the rear bolt guide 46. The receiver latch 54 is generally L-shaped and is pivotably mounted on a receiver latch pin 76. The pressure from the receiver safety latch 70 on one end of the receiver latch 54 results in the opposing end of the receiver latch 54 being biased to frictionally engage the angled portion of the receiver latch seat 74. As long as the opposing end of the receiver latch 54 frictionally engages the angled portion of the receiver latch seat 74, the upper receiver 12 cannot be separated from the lower receiver 14.

If a user inadvertently or deliberately presses the receiver latch 54 with the bolt assembly 30 locked, the side wall of the rear bolt guide 46 interacts with the tab 68 on the receiver safety latch 70 to prevent the receiver safety latch 70 from rising. Because the notch 66 in the rear side wall of the rear bolt guide 46 is not aligned with the tab 68 on the receiver safety latch 70, the receiver safety latch 70 cannot rise and compress the receiver latch spring 72. When the receiver safety latch 70 cannot rise, the receiver latch 54 cannot pivot about the receiver latch pin 76 and disengage from the receiver latch seat 74 of the upper receiver tab 78. Therefore, the upper receiver 12 cannot be separated from the lower receiver 14 when the bolt assembly 30 is locked, even if the user removes the takedown pin 18 from the takedown pin hole 20 and takedown pin sleeve 22.

Figure 7:
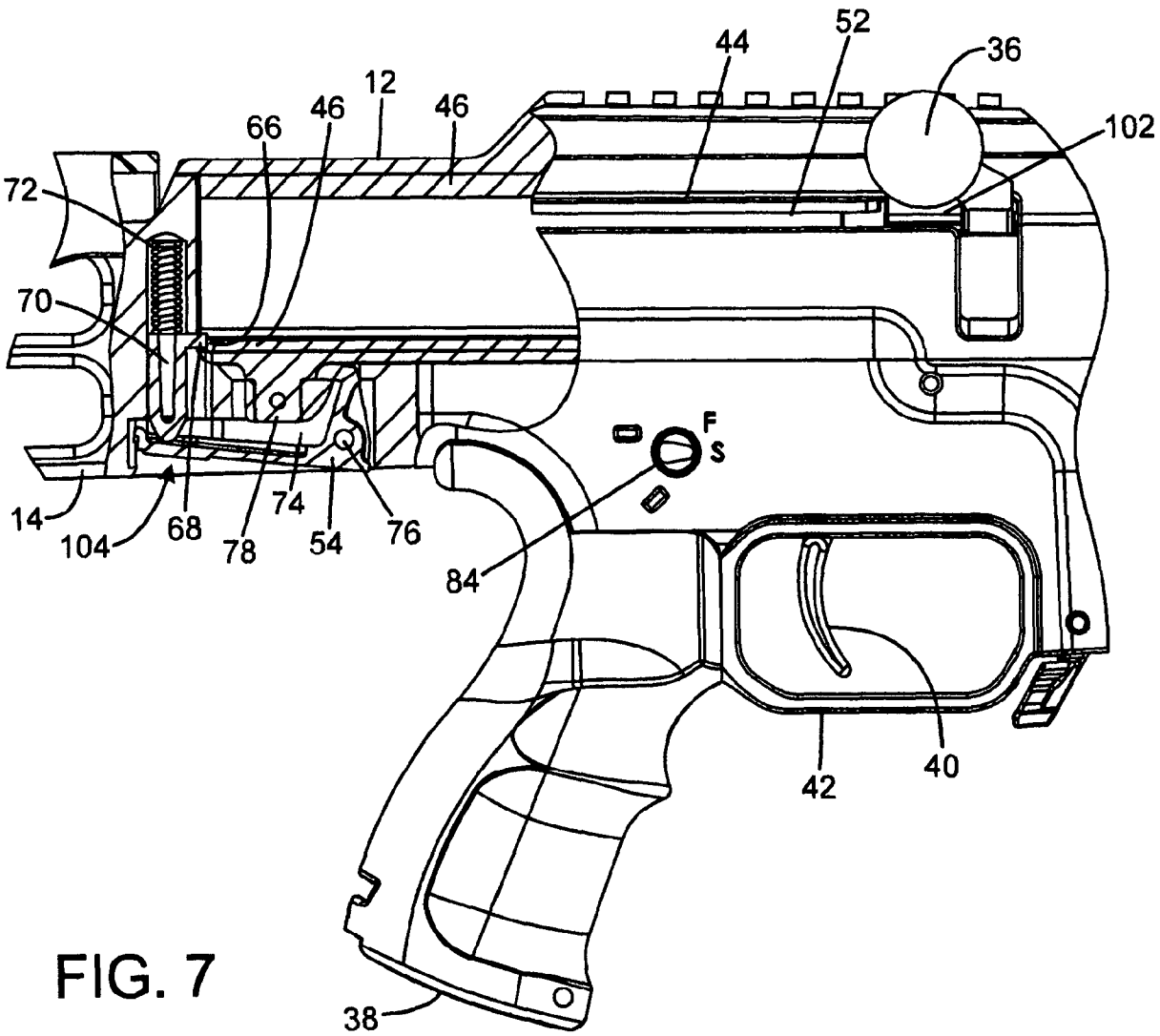
FIG. 7 is a right side sectional view of the current embodiment of the bolt action rifle with safety latching mechanism of the present invention.

FIGS. 7 and 8A depict the bolt action rifle 10 with the bolt assembly 30 forward and unlocked. Lifting the bolt handle 36 unlocks the bolt head 48 and rotates the rear bolt guide 46 so that its notch 66 is aligned with the tab 68 on the receiver safety latch 70 and its rear bolt guide slot 52 is aligned with the bolt handle slot 44. Although the receiver latch spring 72 continues to push receiver the safety latch 70 downward to bias the receiver latch 54 into its latched position engaged with the receiver latch seat 74, the receiver latch 54 can be actuated to disengage from the receiver latch seat 74. This is accomplished by depressing the receiver latch 54 and raising the receiver safety latch 70 as shown in FIG. 7. Even with a cartridge loaded into the chamber 56, the firing pin 62 is not cocked with the bolt handle 36 in its open position. Therefore, the firing pin 62 cannot reach the cartridge to discharge it even with the sear 92 disengaged from the firing pin spring 82.

Figure 9:
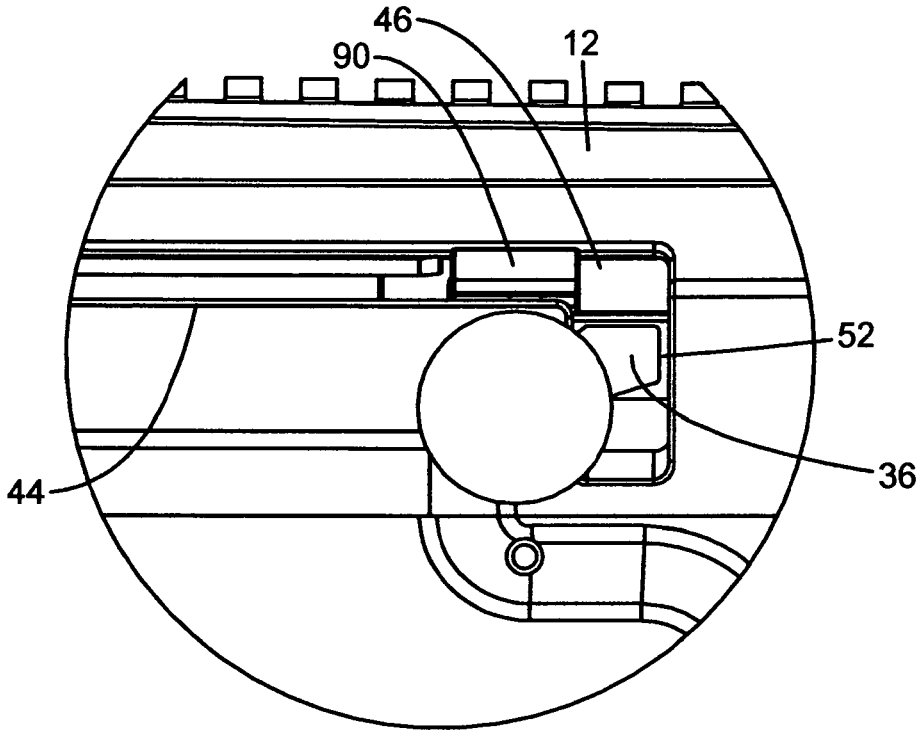
FIG. 9 is an enlarged right side fragmentary view of the current embodiment of the bolt action rifle with safety latching mechanism of the present invention.

FIG. 9 illustrates the bolt action rifle 10 of the present invention. More particularly, the interaction of the bolt handle 36 with the rear bolt guide slot 52 is illustrated. When the bolt handle 36 is in the horizontal stroked portion of the L-shaped bolt handle slot 44, the bolt handle 36 can be raised and lowered. This action engages with the side walls of the rear bolt guide slot 52 to axially rotate the rear bolt guide 46 within the upper receiver 12. The endpoints of the range of rotational motion of the rear bolt guide 46 are illustrated in FIGS. 8A and 8B.

When the bolt assembly 30 is locked, the rear bolt guide slot 52 is not aligned with the bolt handle slot 44. Instead, a solid surface portion of the rear bolt guide 46 blocks the entire bolt handle slot 44, which prevents dirt and debris from entering the weapon through the rear bolt guide slot 52 and bolt handle slot 44. Conversely, when the bolt assembly 30 is not locked, the rear bolt guide slot 52 is aligned with the bolt handle slot 44. This position permits the cocking piece 90 and protrusion 102 to slide within the rear bolt guide slot 52 and bolt handle slot 44.

While current embodiments of the bolt action rifle with safety latching mechanism have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. And although preventing separation of the lower receiver from the upper receiver while the rifle is cocked to fire has been described, it should be appreciated that the bolt action rifle with safety latching mechanism herein described is also suitable for preventing dirt and debris from entering the weapon when the bolt assembly is in its locked position.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A lower receiver for a bolt action rifle comprising:

a lower receiver body operable to releasably attach to an upper receiver, the lower receiver having a trigger; the lower receiver including a receiver latch having opposing ends pivotably mounted on the receiver latch pin;

a receiver safety latch having opposing ends; and a receiver latch spring having opposing ends with one end frictionally engaged with one end of the receiver safety latch opposite the receiver latch and its opposing end frictionally engaged with the lower receiver;

and a tab attached to one end of the receiver safety latch adjacent to the receiver latch spring;

the receiver safety latch and receiver latch operable to preclude the lower receiver body from being released from the upper receiver.

2. The lower receiver of claim 1 further comprising a stock.

3. The lower receiver of claim 1 further comprising a pistol grip.

4. The lower receiver of claim 2 further comprising a magazine well.

* * * * *